US011783761B2

(12) United States Patent
Tseng et al.

(10) Patent No.: US 11,783,761 B2
(45) Date of Patent: Oct. 10, 2023

(54) ELECTRONIC DEVICE

(71) Applicant: Innolux Corporation, Miao-Li County (TW)

(72) Inventors: Ming-Chun Tseng, Miao-Li County (TW); Kung-Chen Kuo, Miao-Li County (TW); Lien-Hsiang Chen, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/727,815

(22) Filed: Apr. 25, 2022

(65) Prior Publication Data

US 2022/0392399 A1 Dec. 8, 2022

Related U.S. Application Data

(60) Provisional application No. 63/192,574, filed on May 25, 2021.

(30) Foreign Application Priority Data

Jan. 7, 2022 (CN) ..... 202210018344.X

(51) Int. Cl.
*G09G 3/32* (2016.01)

(52) U.S. Cl.
CPC ..... *G09G 3/32* (2013.01); *G09G 2300/0814* (2013.01); *G09G 2330/04* (2013.01)

(58) Field of Classification Search
CPC ..... G09G 3/32; G09G 2300/0814; G09G 2330/04; G09G 2300/0842; G09G 2300/0861; G09G 3/3233
See application file for complete search history.

(56) References Cited

U.S. PATENT DOCUMENTS

| | | | | |
|---|---|---|---|---|
| 10,935,823 | B2 | 3/2021 | Lee et al. | |
| 2015/0379956 | A1* | 12/2015 | Nonaka | G09G 3/325 315/172 |
| 2019/0312098 | A1* | 10/2019 | Matsueda | H10K 59/131 |
| 2020/0394953 | A1* | 12/2020 | Kim | G09G 3/32 |

* cited by examiner

*Primary Examiner* — Andrew Sasinowski
(74) *Attorney, Agent, or Firm* — JCIPRNET

(57) ABSTRACT

The disclosure provides an electronic device including a pixel circuit and a protection circuit. The pixel circuit includes a driving transistor. The protection circuit includes a first connection transistor, a first switching transistor, and a logic circuit. The first connection transistor is coupled to the driving transistor. The first switching transistor is coupled to the first connection transistor. The logic circuit is coupled to the first switching transistor. The electronic device of the disclosure may provide a pixel protection function through the protection circuit coupled with the pixel circuit.

19 Claims, 6 Drawing Sheets

ELECTRONIC DEVICE

CROSS-REFERENCE TO RELATED APPLICATION

This application claims the priority benefits of U.S. provisional application Ser. No. 63/192,574, filed on May 25, 2021, and China application serial no. 202210018344.X, filed on Jan. 7, 2022. The entirety of each of the above-mentioned patent applications is hereby incorporated by reference herein and made a part of this specification.

BACKGROUND

Technical Field

The disclosure relates to a device, and more particularly to an electronic device with an element protection function.

Description of Related Art

With the advancement of technology, electronic devices are gradually designed to be light, thin, and compact. However, element reliability may thus face increasingly huge challenges, especially those safety problems related to elements of electronic devices such as damage caused by continuous high current and high temperature that people have to face.

SUMMARY

The disclosure is directed to an electronic device that may provide an element protection function through a protection circuit coupled with a pixel circuit.

According to some embodiments of the disclosure, the electronic device of the disclosure includes a pixel circuit and a protection circuit. The pixel circuit includes a driving transistor. The protection circuit includes a first connection transistor, a first switching transistor, and a logic circuit. The first connection transistor is coupled to the driving transistor. The first switching transistor is coupled to the first connection transistor. The logic circuit is coupled to the first switching transistor.

According to some embodiments of the disclosure, the electronic device of the disclosure may detect an operation signal (e.g., a scan signal and/or a reset signal) of the pixel circuit through the protection circuit. When the operation signal of the pixel circuit is abnormal, the protection circuit may close the driving transistor of the pixel circuit of abnormal pixels and may thus provide the element protection function.

Embodiments accompanied with drawings are described in detail below to make the aforementioned features and advantages of the disclosure comprehensible.

DESCRIPTION OF THE EMBODIMENTS

Figure 1:
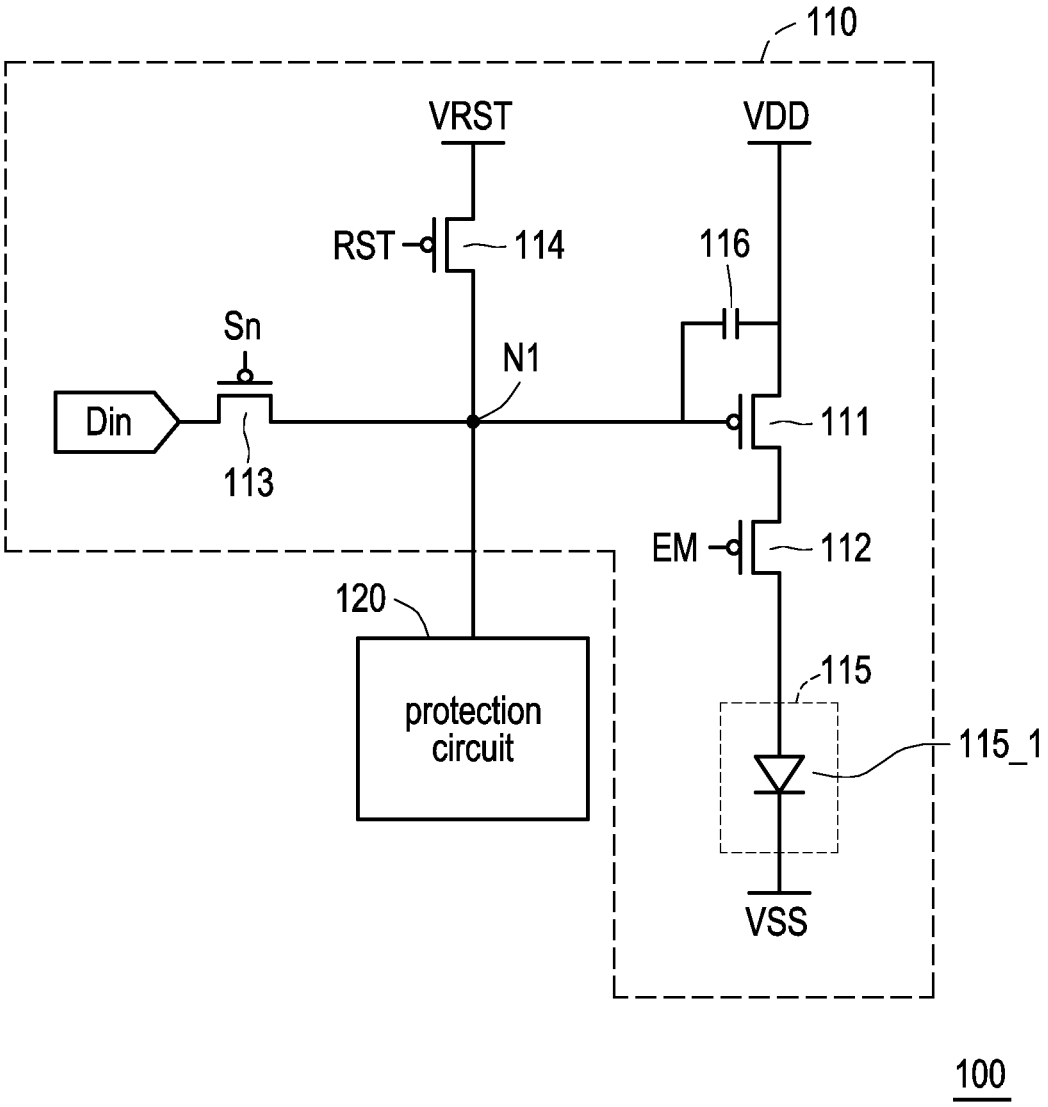
FIG. 1 is a schematic diagram of an electronic device according to some embodiments of the disclosure.

References of the exemplary embodiments of the disclosure are to be made in detail. Examples of the exemplary embodiments are illustrated in the drawings. If applicable, the same reference numerals in the drawings and the descriptions indicate the same or similar parts.

The disclosure may be understood by referring to the following detailed description in conjunction with the accompanying drawings. It should be noted that, in order to facilitate understanding and for concision of the drawings, only a part of an electronic device is shown in multiple drawings in the disclosure, and certain elements in the drawings are not drawn to actual scale. In addition, the number and size of each element in the drawings are only exemplary and are not used to limit the scope of the disclosure.

Certain words will be used to refer to specific devices throughout the specification and the appended claims of the disclosure. People skilled in the art should understand that electronic device manufacturers may refer to same components under different names. The disclosure does not intend to distinguish between components having same functions but different names. In the following specification and claims, the words "having" and "including" are open-ended words and thus should be interpreted as "including but not limited to."

In some embodiments of the disclosure, terms concerning attachments and connections such as "connected," "interconnected," and the like, unless defined otherwise, mean two structures directly contact each other, or mean the two structures do not directly contact each other and other structures are disposed therebetween. The terms concerning attachments and connections may also include a relationship in which the two structures are both movable or fixed. In addition, the terms "electrically connected to" and "coupled to" include any direct and indirect electrical connection means.

Ordinal numbers in this specification and the claims such as "first" and "second" are used to modify a device, and do not imply or represent that the (or these) component(s) has (or have) any ordinal number, and do not indicate any order between an element and another element, or an order in a manufacturing method. These ordinal numbers are merely used to clearly distinguish an element having a name with another element having the same name. Different terms may be used in the claims and the specification, so that a first member in the specification may be a second member in the claims. It should be understood that the following embodiments may replace, reorganize, and mix the technical features in several different embodiments to complete other embodiments without departing from the spirit of the disclosure.

It should be understood that the following embodiments may replace, reorganize, and mix the features in several different embodiments to complete other embodiments without departing from the spirit of the disclosure. As long as the features of the embodiments do not violate the spirit of the disclosure or conflict each other, they may be mixed and matched as desired.

In the following embodiments of the disclosure, an electronic device may include a display device, an antenna device, a sensing device, or a splicing device, but the disclosure is not limited thereto. The electronic device may be a bendable electronic device or a flexible electronic device. The electronic device includes a diode element, which may or may not emit light. The diode element may include, for example, a PN diode or a PIN diode, but the disclosure is not limited thereto. The electronic device may include, for example, liquid crystal (LC), a light emitting diode, a quantum dot (QD), fluorescence, phosphor, other suitable materials, or a combination of the above materials, but the disclosure is not limited thereto. The light emitting diode may include, for example, an organic light emitting diode or an inorganic light emitting diode. The light emitting diode may include, for example, an active-matrix organic light emitting diode (AMOLED), an organic light emitting diode (OLED), a mini light emitting diode (mini LED), a micro light emitting diode (micro LED), a quantum dot light emitting diode, or the like, but the disclosure is not limited thereto. The antenna device may be, for example but not limited to, a liquid crystal antenna. The splicing device may be, for example but not limited to, a display splicing device or an antenna splicing device. It should be noted that the electronic device may be any combination of the foregoing, but the disclosure is not limited thereto.

In the following embodiments, the first end, the second end, and the control end of a transistor may refer to, for example, a source, a gate, and a drain of a thin-film transistor (TFT), a metal-oxide-semiconductor field-effect transistor (MOSFET), or other transistors.

FIG. 1 is a schematic diagram of an electronic device according to some embodiments of the disclosure. With reference to FIG. 1, an electronic device 100 includes a pixel circuit 110 and a protection circuit 120. The pixel circuit 110 includes a driving transistor 111, a pixel switching transistor 112, a scan transistor 113, a reset transistor 114, a diode element 115, and a storage capacitor (Cst) 116. In this embodiment, the first end of the driving transistor 111 is coupled to an operation voltage VDD. The second end of the driving transistor 111 is coupled to the first end of the pixel switching transistor 112. The control end of the driving transistor 111 is coupled to the first end of the driving transistor 111 and is coupled to the scan transistor 113, the reset transistor 114, and the protection circuit 120 through a circuit node N1. The second end of the pixel switching transistor 112 is coupled to the first end of the diode element 115. The control end of the pixel switching transistor 112 may receive a control signal EM. The first end of the scan transistor 113 may receive driving data (or display data) Din. The control end of the scan transistor 113 may receive a scan signal Sn. The second end of the scan transistor 113 is coupled to the control end of the driving transistor 111 through the circuit node N1. The first end of the reset transistor 114 is coupled to a reset voltage VRST. The second end of the reset transistor 114 is coupled to the control end of the driving transistor 111 through the circuit node N1. The control end of the reset transistor 114 may receive a reset signal RST. The second end of the diode element 115 is coupled to a ground voltage VSS. In some embodiments, the diode element 115 may include a light emitting diode 115_1. The anode of the light emitting diode 115_1 is coupled to the second end of the pixel switching transistor 112. The cathode of the light emitting diode 115_1 is coupled to the ground voltage VSS. In some embodiments, the diode element 115 may include multiple light emitting diodes connected in series. The first end of the storage capacitor 116 is coupled to the first end of the driving transistor 111, and the second end of the storage capacitor 116 is coupled to the control end of the driving transistor 111.

In this embodiment, the driving transistor 111, the pixel switching transistor 112, the scan transistor 113, and the reset transistor 114 may respectively be P-type thin-film transistors or P-type MOSFETs, but the disclosure is not limited thereto. In addition, in some embodiments, the pixel circuit 110 may further include other transistors and not be limited to the 3T1C pixel circuit architecture shown in FIG. 1. For example, the pixel circuit 110 may be a circuit architecture composed of seven transistors and two capacitors (7T2C) or a circuit architecture composed of eight transistors and two capacitors (8T2C), but the disclosure is not limited thereto. It should be noted that the protection circuit 120 of the disclosure may be applied in various circuit architectures. In some embodiments, the protection circuit 120 and the diode element 115 may be on the same substrate. In some embodiments, the protection circuit 120 and the diode element 115 may be on different substrates.

In this embodiment, the pixel circuit 110 may be respectively operated in a reset mode and a driving mode (which may also be referred to as a display mode or a light emitting mode) during a reset period and a driving period according to the driving data, the control signal EM, the scan signal Sn, and the reset signal RST. In this embodiment, the protection circuit 120 may receive the control signal EM, the scan signal Sn, and the reset signal RST to detect at least one of the scan signal Sn and the reset signal RST. When signal (voltage) abnormality of at least one of the scan signal Sn and the reset signal RST occurs, the protection circuit 120 may provide a shutdown voltage to the control end of the driving transistor 111 through the circuit node N1 to turn off the driving transistor 111, which may effectively protect the diode element 115. In addition, in some embodiments, the protection circuit 120 may further be coupled to other pixel circuits of the electronic device 100.

Figure 2:
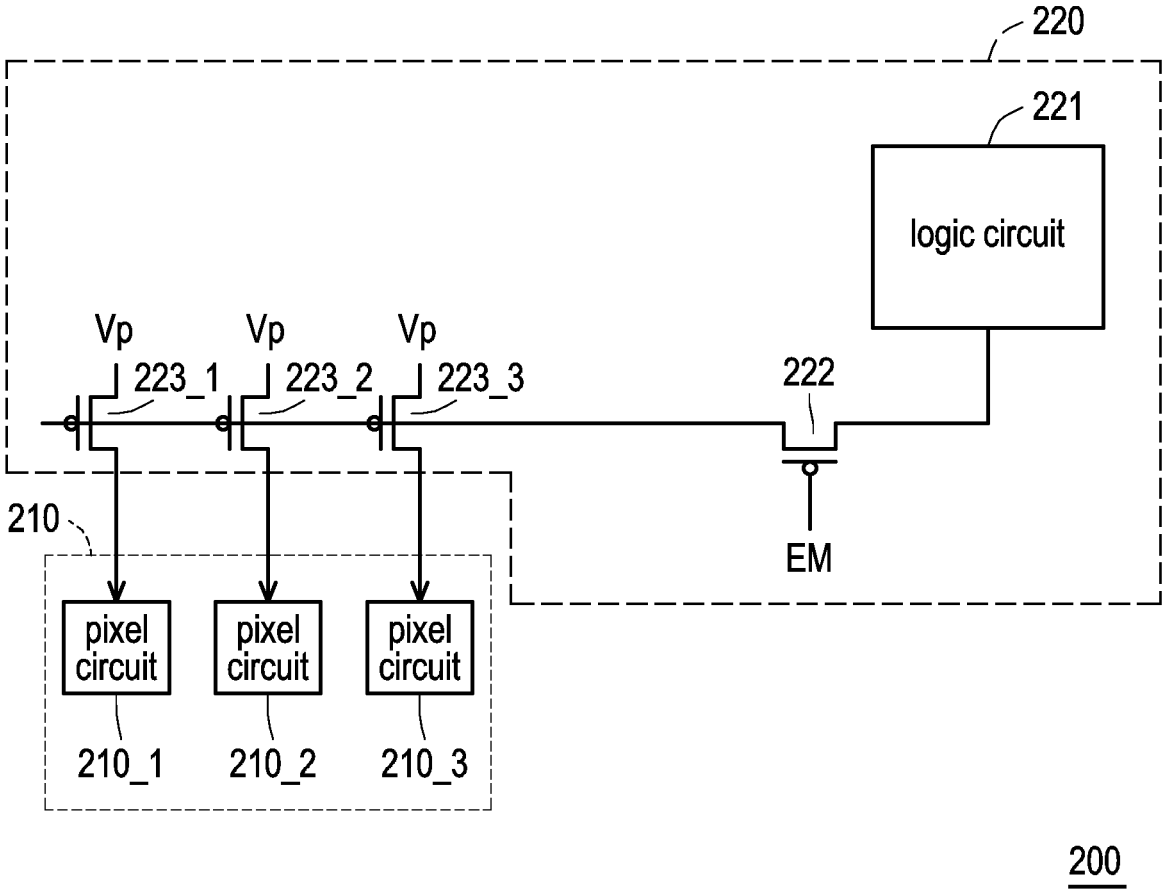
FIG. 2 is another schematic diagram of an electronic device according to some embodiments of the disclosure.

FIG. 2 is another schematic diagram of an electronic device according to some embodiments of the disclosure. With reference to FIG. 2, an electronic device 200 may include a pixel 210 and a protection circuit 220. The pixel 210 may include multiple pixel circuits 210_1 to 210_3, and each of the pixel circuits 210_1 to 210_3 may be respectively implemented as the pixel circuit 110 as described above in the embodiment of FIG. 1, but the number of pixel circuits in the pixel 210 of the disclosure is not limited thereto. In some embodiments, the pixel 210 may include one or multiple pixel circuits. In this embodiment, the pixel circuits 210_1 to 210_3 may, for example, respectively correspond to pixel circuits of red sub-pixels, green sub-pixels, or blue sub-pixels.

In this embodiment, the protection circuit 220 includes a logic circuit 221, a switching transistor 222, and connection transistors 223_1 to 223_3. The connection transistors 223_1 to 223_3 may be respectively coupled to driving transistors in the pixel circuits 210_1 to 210_3 (e.g., the driving transistor 111 in FIG. 1). The logic circuit 221 is coupled to the first end of the switching transistor 222. The second end of the switching transistor 222 is coupled to the control end of the connection transistors 223_1 to 223_3. The control end of the switching transistor 222 may receive the control signal EM. The first ends of the connection transistors 223_1 to 223_3 may receive a protection voltage Vp, and the protection voltage Vp may be the operation voltage VDD shown in FIG. 1, but the disclosure is not limited thereto. The second ends of the connection transistors 223_1 to 223_3 are respectively coupled to the pixel circuits 210_1 to 210_3. In addition, the logic circuit 221 may receive the control signal EM and at least one of the scan signal and the reset signal (the scan signal Sn and the reset signal RST as shown in FIG. 1) to detect at least one of the scan signal and the reset signal.

In this embodiment, the switching transistor 222 and the connection transistors 223_1 to 223_3 may respectively be P-type thin-film transistors or P-type MOSFETs, but the disclosure is not limited thereto. In this embodiment, when signal (e.g., a voltage signal or the like) abnormality (e.g., a false trigger or the like) of at least one of the scan signal and the reset signal occurs, the logic circuit 221 may provide a shutdown voltage to the control end of the driving transistors in the pixel circuits 210_1 to 210_3 through the circuit nodes (the circuit node N1 as shown in FIG. 1) in the switching transistor 222, the connection transistors 223_1 to 223_3, and the pixel circuits 210_1 to 210_3, so as to turn off the driving transistors in the pixel circuits 210_1 to 210_3, which may effectively protect the diode elements (the diode element 115 as shown in FIG. 1) in the pixel circuits 210_1 to 210_3.

Figure 3:
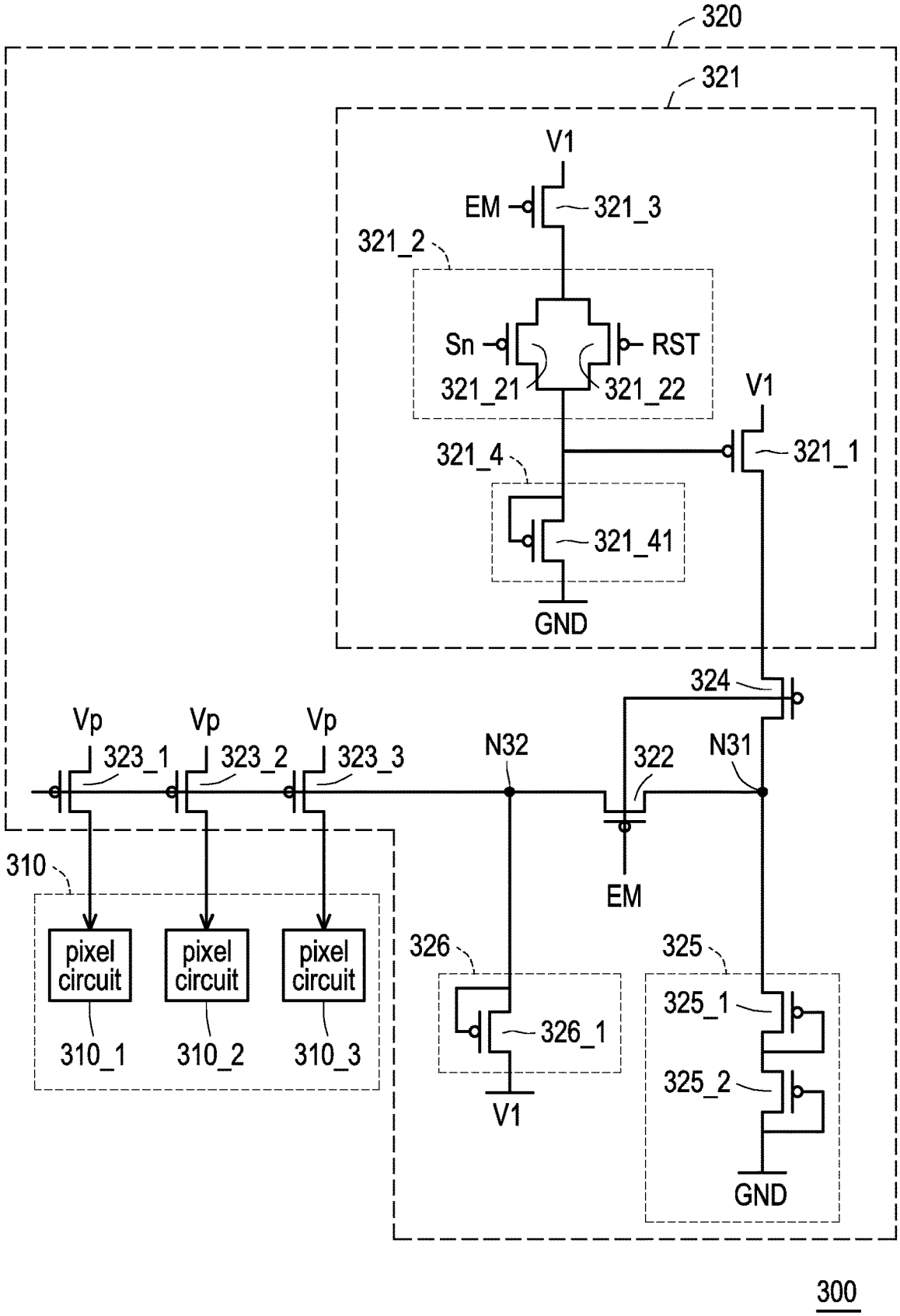
FIG. 3 is a circuit diagram of an electronic device according to some embodiments of the disclosure.

FIG. 3 is a circuit diagram of an electronic device according to some embodiments of the disclosure. With reference to FIG. 3, an electronic device 300 may include a pixel 310 and a protection circuit 320. The pixel 310 may include multiple pixel circuits 310_1 to 310_3, and each of the pixel circuits 310_1 to 310_3 may be respectively implemented as the pixel circuit 110 as described above in the embodiment of FIG. 1, but the number of pixel circuits in the pixel 310 of the disclosure is not limited thereto. In some embodiments, the pixel 310 may include one or multiple pixel circuits. In this embodiment, the pixel circuits 310_1 to 310_3 may, for example, respectively correspond to pixel circuits of red sub-pixels, green sub-pixels, or blue sub-pixels.

In this embodiment, the protection circuit 320 includes a logic circuit 321, switching transistors 322, 324, connection transistors 323_1 to 323_3, and impedance circuits 325, 326. The connection transistors 323_1 to 323_3 may be respectively coupled to driving transistors in the pixel circuits 310_1 to 310_3 (e.g., the driving transistor 111 in FIG. 1). The logic circuit 321 is coupled to the first end of the switching transistor 324. The second end of the switching transistor 324 is coupled to a circuit node N31 between the first end of the switching transistor 322 and the impedance circuit 325. The second end of the switching transistor 322 is coupled to the control end of the connection transistors 323_1 to 323_3 and the impedance circuit 326 through a circuit node N32. The control end of the switching transistors 322 and 324 may receive the control signal EM. The first ends of the connection transistors 323_1 to 323_3 may receive the protection voltage Vp, and the protection voltage Vp may be the operation voltage VDD shown in FIG. 1, but the disclosure is not limited thereto. The second ends of the connection transistors 323_1 to 323_3 are respectively coupled to the pixel circuits 310_1 to 310_3.

In this embodiment, the impedance circuit 325 may include transistors 325_1 and 325_2. The first end of the transistor 325_1 is coupled to the circuit node N31. The second end of the transistor 325_1 is coupled to the control end of the transistor 325_1 and the first end of the transistor 325_2. The second end of the transistor 325_2 is coupled to the control end of the transistor 325_2 and a ground voltage GND. However, in some embodiments, the impedance circuit 325 may also be other types of impedance circuits and not be limited to those shown in FIG. 3.

In this embodiment, the impedance circuit 326 may include a transistor 326_1. The first end of the transistor 326_1 may receive a reference voltage V1, and the reference voltage V1 is a high potential voltage and may be, for example, the protection voltage Vp. The second end of the transistor 326_1 is coupled to the control end of the transistor 326_1 and the circuit node N32. However, in some embodiments, the impedance circuit 326 may also be other types of impedance circuits and not be limited to those shown in FIG. 3.

In this embodiment, the logic circuit 321 includes a circuit connection transistor 321_1, a switching circuit 321_2, a circuit switching transistor 321_3, and an impedance circuit 321_4. The circuit connection transistor 321_1 is coupled between the switching transistor 324 and the reference voltage V1. The first end of the circuit connection transistor 321_1 may receive the reference voltage V1. The second end of the circuit connection transistor 321_1 is coupled to the first end of the switching transistor 324. The switching circuit 321_2 is coupled to the control end of the circuit connection transistor 321_1. The circuit switching transistor 321_3 is coupled to the reference voltage V1. The first end of the circuit switching transistor 321_3 may receive the reference voltage V1. The control end of the circuit switching transistor 321_3 may receive the control signal EM. The second end of the circuit switching transistor 321_3 is coupled to the switching circuit 321_2. The switching circuit 321_2 includes a scan transistor 321_21 and a reset transistor 321_22. The first end of the scan transistor 321_21 and the reset transistor 321_22 is coupled to the second end of the circuit switching transistor 321_3. The control end of the scan transistor 321_21 may receive the scan signal Sn. The control end of the reset transistor 321_22 may receive the reset signal RST. The second end of the scan transistor 321_21 and the reset transistor 321_22 is coupled to the impedance circuit 321_4. The impedance circuit 321_4 may include a transistor 321_41. The first end of the transistor 321_41 is coupled to the control end of the transistor 321_41, and is electrically connected with the control end of the circuit connection transistor 321_1 and the second end of the scan transistor 321_21 and the reset transistor 321_22. The second end of the transistor 321_41 is coupled to the ground voltage GND. However, in some embodiments, the impedance circuit 321_4 may also be other types of impedance circuits and not be limited to those shown in FIG. 3.

In this embodiment, the circuit connection transistor 321_1, the connection transistors 323_1 to 323_3, the scan transistor 321_21, the reset transistor 321_22, the circuit switching transistor 321_3, the switching transistors 322, 324, and the transistors 321_41, 325_1, 325_2, 326_1 may respectively be P-type thin-film transistors or P-type MOSFETs, but the disclosure is not limited thereto.

Figure 4:
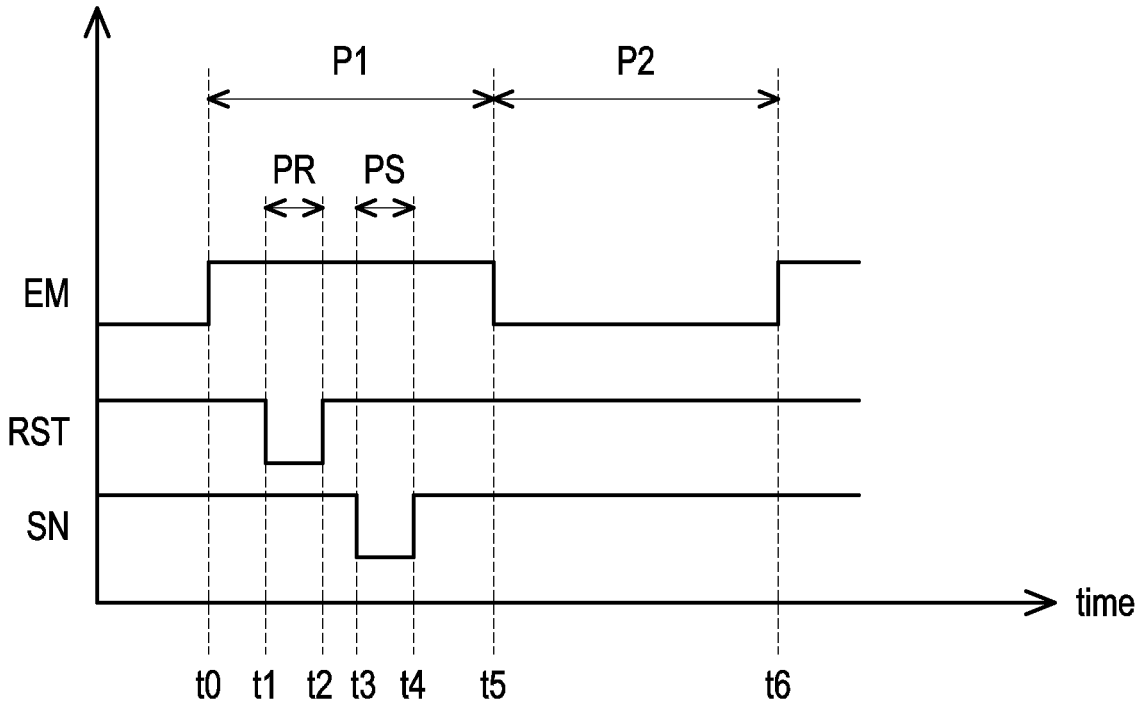
FIG. 4 is a signal timing diagram according to some embodiments of the disclosure.

Please refer to FIG. 3 and FIG. 4 together. FIG. 4 is a signal timing diagram according to some embodiments of the disclosure. In some embodiments of the disclosure, each of the pixel circuits 310_1 to 310_3 may receive the control signal EM, the reset signal RST, and the scan signal Sn to be operated in a setting mode during a setting period P1 from time t0 to time t5 and be operated in a driving mode during a driving period P2 from time t5 to time t6 according to the control signal EM, the reset signal RST, and the scan signal Sn. With reference to Table 1 below, during the setting period P1, the control signal EM is a high potential voltage to turn off the circuit switching transistor 321_3, the switching transistor 322, the switching transistor 324, and the respective pixel switching transistors of the pixel circuits 310_1 to 310_3.

During a reset period PR from time t1 to time t2, the reset signal RST switches from a high potential voltage to a low potential voltage to turn on the respective reset transistors of the pixel circuits 310_1 to 310_3 and respectively reset the storage capacitors of the pixel circuits 310_1 to 310_3. During a period PS from time t3 to time t4, the scan signal Sn switches from a high potential voltage to a low potential voltage to turn on the respective scan transistors of the pixel circuits 310_1 to 310_3 and respectively write the driving data into the storage capacitors of the pixel circuits 310_1 to 310_3. As shown in the operation states 1 to 3 of Table 1 below, the circuit node N31 maintains a low potential voltage, and the circuit node N32 maintains a high potential voltage to turn off the connection transistors 323_1 to 323_3.

During the driving period P2 between time t5 and time t6, the control signal EM is a low potential voltage to turn on the circuit switching transistor 321_3, the switching transistor 322, the switching transistor 324, and the respective pixel switching transistors of the pixel circuits 310_1 to 310_3. The reset signal RST and the scan signal Sn are respectively high potential voltages to turn off the respective reset transistors and the scan transistors of the pixel circuits 310_1 to 310_3. As shown in the operation state 4 of Table 1 below, the circuit nodes N31 and N32 are high potential voltage to turn off the connection transistors 323_1 to 323_3. It should be noted that since the scan transistor 321_21 and the reset transistor 321_22 of the switching circuit 321_2 may also receive the reset signal RST and the scan signal Sn, when signal (voltage) abnormality (a false trigger) of at least one of the reset signal RST and the scan signal Sn occurs, for example, when at least one of the reset signal RST and the scan signal Sn switches from a high potential voltage to a low potential voltage during the driving period P2, then at least one of the scan transistor 321_21 and the reset transistor 321_22 is conducted, and the circuit connection transistor 321_1 is thus conducted as well. As shown in the operation states 5 to 7 of Table 1 below, when signal (voltage) abnormality of at least one of the reset signal RST and the scan signal Sn occurs, the circuit nodes N31 and N32 may respectively switch to a low potential voltage to conduct the connection transistors 323_1 to 323_3. In this regard, the circuit connection transistor 321_1 may provide the reference voltage V1 to the control end of the connection transistors 323_1 to 323_3 through the switching transistors 322, 324 and the circuit nodes N31, N32 to conduct the connection transistors 323_1 to 323_3. Next, the connection transistors 323_1 to 323_3 may respectively provide the protection voltage Vp to the respective driving transistors of the pixel circuits 310_1 to 310_3 to turn off the driving transistors. Therefore, the protection circuit 320 may effectively protect the diode elements in the pixel circuits 310_1 to 310_3 of the pixel 310 and may avoid the voltage signal abnormality of at least one of the reset signal RST and the scan signal Sn from causing the damage to the diode elements in the pixel circuits 310_1 to 310_3, which may thus achieve the current overload protection function of the pixel 310.

In this embodiment, the protection circuit 520 includes a logic circuit 521, switching transistors 522, 524, connection transistors 523_1 to 523_3, and impedance circuits 525, 526. The connection transistors 523_1 to 523_3 may be respectively coupled to the driving transistors (e.g., the driving transistor 111 in FIG. 1) in the connection transistors 523_1 to 523_3. The logic circuit 521 is coupled to the first end of the switching transistor 524 and the first end of the switching transistor 522 through a circuit node N51. The second end of the switching transistor 524 is coupled to the impedance circuit 525. The second end of the switching transistor 522 is coupled to the control end of the connection transistors 523_1 to 523_3 and the impedance circuit 526 through the circuit node N52. The control end of the switching transistors 522 and 524 may receive the control signal EM. The first ends of the connection transistors 523_1 to 523_3 may receive the protection voltage Vp, and the protection voltage Vp may be the operation voltage VDD shown in FIG. 1, but the disclosure is not limited thereto. The second ends of the connection transistors 523_1 to 523_3 are respectively coupled to the pixel circuits 510_1 to 510_3.

In this embodiment, the impedance circuit 525 may include transistors 525_1 and 525_2. The first end of the transistor 525_1 is coupled to the second end of the switching transistor 524. The second end of the transistor 525_1 is coupled to the control end of the transistor 525_1 and the first end of the transistor 525_2. The second end of the transistor 525_2 is coupled to the control end of the transistor 525_2 and the ground voltage GND. However, in some embodiments, the impedance circuit 525 may also be other types of impedance circuits and not be limited to those shown in FIG. 5.

TABLE 1

| | control signal EM | reset signal RST | scan signal Sn | circuit node N31 | circuit node N32 |
|---|---|---|---|---|---|
| operation state 1 | high potential | low potential | low potential | low potential | high potential |
| operation state 2 | high potential | high potential | low potential | low potential | high potential |
| operation state 3 | high potential | low potential | high potential | low potential | high potential |
| operation state 4 | low potential | high potential | high potential | high potential | high potential |
| operation state 5 | low potential | low potential | high potential | low potential | low potential |
| operation state 6 | low potential | high potential | low potential | low potential | low potential |
| operation state 7 | low potential | low potential | low potential | low potential | low potential |

In addition, in some embodiments, the switching circuit 321_2 may include only one of the scan transistor 321_21 and the reset transistor 321_22, and when signal (voltage) abnormality of one of the scan signal Sn and the reset signal RST occurs, the protection circuit 320 may conduct the connection transistors 323_1 to 323_3 to turn off the respective driving transistors of the pixel circuits 310_1 to 310_3, which may thus achieve the current overload protection function of the pixel 310.

Figure 5:
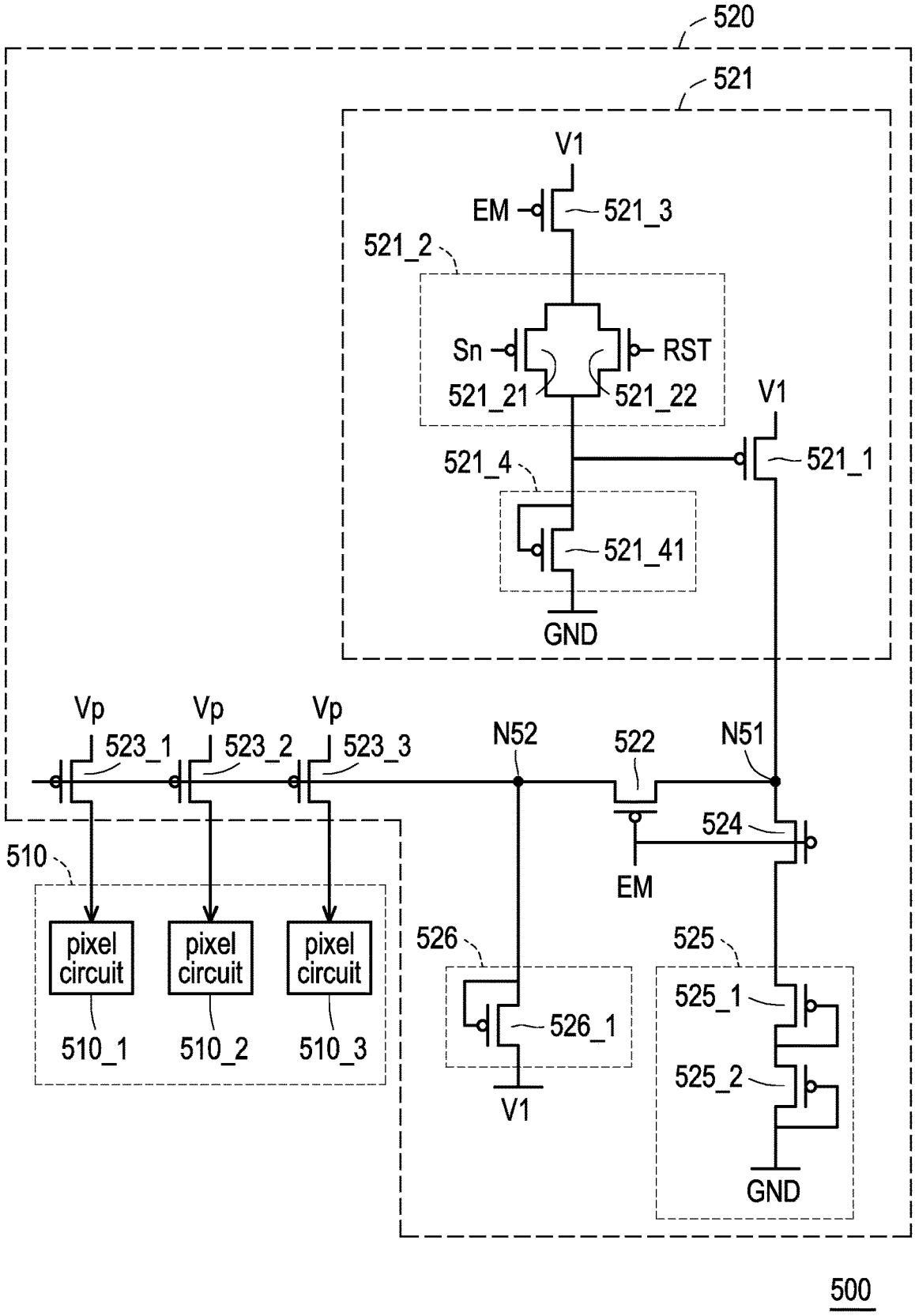
FIG. 5 is a circuit diagram of an electronic device according to some embodiments of the disclosure.

FIG. 5 is a circuit diagram of an electronic device according to some embodiments of the disclosure. With reference to FIG. 5, an electronic device 500 may include a pixel 510 and a protection circuit 520. The pixel 510 may include multiple pixel circuits 510_1 to 510_3, and each of the pixel circuits 510_1 to 510_3 may be respectively implemented as the pixel circuit 110 as described above in FIG. 1, but the number of pixel circuits in the pixel 510 of the disclosure is not limited thereto. In some embodiments, the pixel 510 may include one or multiple pixel circuits. In this embodiment, the pixel circuits 510_1 to 510_3 may, for example, respectively correspond to pixel circuits of red sub-pixels, green sub-pixels, or blue sub-pixels.

In this embodiment, the impedance circuit 526 may include a transistor 526_1. The first end of the transistor 526_1 may receive the reference voltage V1, and the reference voltage V1 is a high potential voltage and may be, for example, the protection voltage Vp. The second end of the transistor 526_1 is coupled to the control end of the transistor 526_1 and the circuit node N52. However, in some embodiments, the impedance circuit 526 may also be other types of impedance circuits and not be limited to those shown in FIG. 5.

In this embodiment, the logic circuit 521 includes a circuit connection transistor 521_1, a switching circuit 521_2, a circuit switching transistor 521_3, and an impedance circuit 521_4. The circuit connection transistor 521_1 is coupled between the circuit node N51 and the reference voltage V1. The first end of the circuit connection transistor 521_1 may receive the reference voltage V1. The second end of the circuit connection transistor 521_1 is coupled to the first end of the switching transistor 524. The switching circuit 521_2 is coupled to the control end of the circuit connection transistor 521_1. The circuit switching transistor 521_3 is coupled to the reference voltage V1. The first end of the circuit switching transistor 521_3 may receive the reference voltage V1. The control end of the circuit switching transistor 521_3 may receive the control signal EM. The second end of the circuit switching transistor 521_3 is coupled to the switching circuit 521_2. The switching circuit 521_2 includes a scan transistor 521_21 and a reset transistor 521_22. The first end of the scan transistor 521_21 and the reset transistor 521_22 is coupled to the second end of the circuit switching transistor 521_3. The control end of the scan transistor 521_21 may receive the scan signal Sn. The control end of the reset transistor 521_22 may receive the reset signal RST. The second end of the scan transistor 521_21 and the reset transistor 521_22 is coupled to the impedance circuit 521_4. The impedance circuit 521_4 may include a transistor 521_41. The first end of the transistor 521_41 is coupled to the control end of the transistor 521_41, and is electrically connected with the control end of the circuit connection transistor 521_1 and the second end of the scan transistor 521_21 and the reset transistor 521_22. The second end of the transistor 521_41 is coupled to the ground voltage GND. However, in some embodiments, the impedance circuit 521_4 may also be other types of impedance circuits and not be limited to those shown in FIG. 5.

In this embodiment, the circuit connection transistor 521_1, the connection transistors 523_1 to 523_3, the scan transistor 521_21, the reset transistor 521_22, the circuit switching transistor 521_3, the switching transistors 522, 524, and the transistors 521_41, 525_1, 525_2, 526_1 may respectively be P-type thin-film transistors or P-type MOSFETs, but the disclosure is not limited thereto.

With reference to FIG. 4 and FIG. 5 together, the signal timing of FIG. 4 may also be applied to an electronic device 500 of FIG. 5. In some embodiments of the disclosure, each of the pixel circuits 510_1 to 510_3 may receive the control signal EM, the reset signal RST, and the scan signal Sn to be operated in a setting mode during the setting period P1 from time t0 to time t5 and be operated in a driving mode during the driving period P2 from time t5 to time t6 according to the control signal EM, the reset signal RST, and the scan signal Sn. With reference to Table 2 below, during the setting period P1, the control signal EM is a high potential voltage to turn off the circuit switching transistor 521_3, the switching transistor 522, the switching transistor 524, and the respective pixel switching transistors of the pixel circuits 510_1 to 510_3.

During the reset period PR from time t1 to time t2, the reset signal RST switches from a high potential voltage to a low potential voltage to turn on the respective reset transistors of the pixel circuits 510_1 to 510_3 and respectively reset the storage capacitors of the pixel circuits 510_1 to 510_3. During the period PS from time t3 to time t4, the scan signal Sn switches from a high potential voltage to a low potential voltage to turn on the respective scan transistors of the pixel circuits 510_1 to 510_3 and respectively write the driving data into the storage capacitors of the pixel circuits 510_1 to 510_3. As shown in the operation states 1 to 3 of Table 2 below, the circuit nodes N51 and N52 maintain a high potential voltage to turn off the connection transistors 523_1 to 523_3.

During the driving period P2 between time t5 and time t6, the control signal EM is a low potential voltage to turn on the circuit switching transistor 521_3, the switching transistor 522, the switching transistor 524, and the respective pixel switching transistors of the pixel circuits 510_1 to 510_3. The reset signal RST and the scan signal Sn are respectively high potential voltages to turn off the respective reset transistors and the scan transistors of the pixel circuits 510_1 to 510_3. As shown in the operation state 4 of Table 2 below, the circuit nodes N51 and N52 are high potential voltage, so as to turn off the connection transistors 523_1 to 523_3. It should be noted that since the scan transistor 521_21 and the reset transistor 521_22 of the switching circuit 521_2 may also receive the reset signal RST and the scan signal Sn, when signal (voltage) abnormality (a false trigger) of at least one of the reset signal RST and the scan signal Sn occurs, for example, when at least one of the reset signal RST and the scan signal Sn switches from a high potential voltage to a low potential voltage during the driving period P2, then at least one of the scan transistor 521_21 and the reset transistor 521_22 is conducted, and the circuit connection transistor 521_1 is thus conducted as well. As shown in the operation states 5 to 7 of Table 2 below, when signal (voltage) abnormality of at least one of the reset signal RST and the scan signal Sn occurs, the circuit nodes N51 and N52 may respectively switch to a low potential voltage to conduct the connection transistors 523_1 to 523_3. In this regard, the circuit connection transistor 521_1 may provide the reference voltage V1 to the control end of the connection transistors 523_1 to 523_3 through the switching transistors 522, 524 and the circuit nodes N51, N52 to conduct the connection transistors 523_1 to 523_3. Next, the connection transistors 523_1 to 523_3 may respectively provide the protection voltage Vp to the respective driving transistors of the pixel circuits 510_1 to 510_3 to turn off the driving transistors. Therefore, the protection circuit 520 may effectively protect the diode elements in the pixel circuits 510_1 to 510_3 of the pixel 510 and may avoid the voltage signal abnormality of at least one of the reset signal RST and the scan signal Sn from causing the damage to the diode elements in the pixel circuits 510_1 to 510_3, which may thus achieve the current overload protection function of the pixel 510.

TABLE 2

| | control signal EM | reset signal RST | scan signal Sn | circuit node N51 | circuit node N52 |
|---|---|---|---|---|---|
| operation state 1 | high potential | low potential | low potential | high potential | high potential |
| operation state 2 | high potential | high potential | low potential | high potential | high potential |
| operation state 3 | high potential | low potential | high potential | high potential | high potential |
| operation state 4 | low potential | high potential | high potential | high potential | high potential |
| operation state 5 | low potential | low potential | high potential | low potential | low potential |
| operation state 6 | low potential | high potential | low potential | low potential | low potential |
| operation state 7 | low potential | low potential | low potential | low potential | low potential |

In addition, in some embodiments, the switching circuit 521_2 may include only one of the scan transistor 521_21 and the reset transistor 521_22, and when signal (voltage) abnormality of one of the scan signal Sn and the reset signal RST occurs, the protection circuit 520 may conduct the connection transistors 523_1 to 523_3 to turn off the respective driving transistors of the pixel circuits 510_1 to 510_3, which may thus achieve the current overload protection function of the pixel 510.

Figure 6:
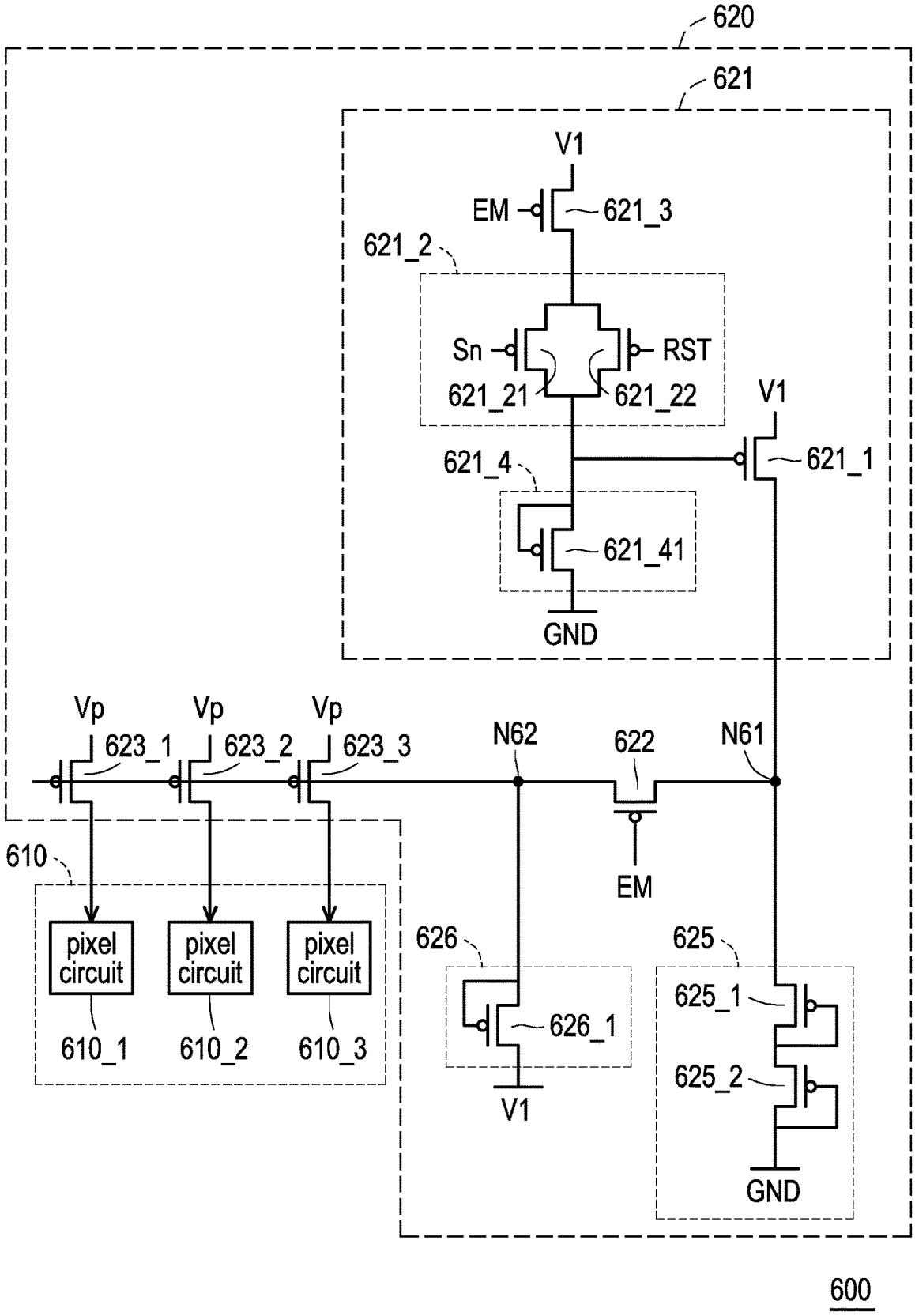
FIG. 6 is a circuit diagram of an electronic device according to some embodiments of the disclosure.

FIG. 6 is a circuit diagram of an electronic device according to a third embodiment of the disclosure. With reference to FIG. 6, an electronic device 600 may include a pixel 610 and a protection circuit 620. The pixel 610 may include multiple pixel circuits 610_1 to 610_3, and each of the pixel circuits 610_1 to 610_3 may be respectively implemented as the pixel circuit 110 as described above in FIG. 1, but the number of pixel circuits in the pixel 610 of the disclosure is not limited thereto. In some embodiments, the pixel 610 may include one or multiple pixel circuits. In this embodiment, the pixel circuits 610_1 to 610_3 may, for example, respectively correspond to pixel circuits of red sub-pixels, green sub-pixels, or blue sub-pixels.

In this embodiment, the protection circuit 620 includes a logic circuit 621, a switching transistor 622, connection transistors 623_1 to 623_3, and impedance circuits 625, 626. The connection transistors 623_1 to 623_3 may be respectively coupled to the driving transistors (e.g., the driving transistor 111 in FIG. 1) in the connection transistors 623_1 to 623_3. The logic circuit 621 is coupled to the first end of the switching transistor 622 and the impedance circuit 625 through a circuit node N61. The second end of the switching transistor 622 is coupled to the control end of the connection transistors 623_1 to 623_3 and the impedance circuit 626 through a circuit node N62. The control end of the switching transistor 622 may receive the control signal EM. The first ends of the connection transistors 623_1 to 623_3 may receive the protection voltage Vp, and the protection voltage Vp may be the operation voltage VDD shown in FIG. 1, but the disclosure is not limited thereto. The second ends of the connection transistors 623_1 to 623_3 are respectively coupled to the pixel circuits 610_1 to 610_3.

In this embodiment, the impedance circuit 625 may include transistors 625_1 and 625_2. The first end of the transistor 625_1 is coupled to the circuit node N61. The second end of the transistor 625_1 is coupled to the control end of the transistor 625_1 and the first end of the transistor 625_2. The second end of the transistor 625_2 is coupled to the control end of the transistor 625_2 and the ground voltage GND. However, in some embodiments, the impedance circuit 625 may also be other types of impedance circuits and not be limited to those shown in FIG. 6.

In this embodiment, the impedance circuit 626 may include a transistor 626_1. The first end of the transistor 626_1 may receive the reference voltage V1, and the reference voltage V1 is a high potential voltage and may be, for example, the protection voltage Vp. The second end of the transistor 626_1 is coupled to the control end of the transistor 626_1 and the circuit node N62. However, in some embodiments, the impedance circuit 626 may also be other types of impedance circuits and not be limited to those shown in FIG. 6.

In this embodiment, the logic circuit 621 includes a circuit connection transistor 621_1, a switching circuit 621_2, a circuit switching transistor 621_3, and an impedance circuit 621_4. The circuit connection transistor 621_1 is coupled between the circuit node N61 and the reference voltage V1. The first end of the circuit connection transistor 621_1 may receive the reference voltage V1. The second end of the circuit connection transistor 621_1 is coupled to the first end of the switching transistor 622. The switching circuit 621_2 is coupled to the control end of the circuit connection transistor 621_1. The circuit switching transistor 621_3 is coupled to the reference voltage V1. The first end of the circuit switching transistor 621_3 may receive the reference voltage V1. The control end of the circuit switching transistor 621_3 may receive the control signal EM. The second end of the circuit switching transistor 621_3 is coupled to the switching circuit 621_2. The switching circuit 621_2 includes a scan transistor 621_21 and a reset transistor 621_22. The first end of the scan transistor 621_21 and the reset transistor 621_22 is coupled to the second end of the circuit switching transistor 621_3. The control end of the scan transistor 621_21 may receive the scan signal Sn. The control end of the reset transistor 621_22 may receive the reset signal RST. The second end of the scan transistor 621_21 and the reset transistor 621_22 is coupled to the impedance circuit 621_4. The impedance circuit 621_4 may include a transistor 621_41. The first end of the transistor 621_41 is coupled to the control end of the transistor 621_41, and is electrically connected with the control end of the circuit connection transistor 621_1 and the second end of the scan transistor 621_21 and the reset transistor 621_22. The second end of the transistor 621_41 is coupled to the ground voltage GND. However, in some embodiments, the impedance circuit 621_4 may also be other types of impedance circuits and not be limited to those shown in FIG. 6.

In this embodiment, the circuit connection transistor 621_1, the connection transistors 623_1 to 623_3, the scan transistor 621_21, the reset transistor 621_22, the circuit switching transistor 621_3, the switching transistor 622, and the transistors 621_41, 625_1, 625_2, 626_1 may respectively be P-type thin-film transistors or P-type MOSFETs, but the disclosure is not limited thereto.

With reference to FIG. 4 and FIG. 6 together, the signal timing of FIG. 4 may also be applied to an electronic device 600 of FIG. 6. In some embodiments of the disclosure, each of the pixel circuits 610_1 to 610_3 may receive the control signal EM, the reset signal RST, and the scan signal Sn to be operated in a setting mode during the setting period P1 from time t0 to time t5 and be operated in a driving mode during the driving period P2 from time t5 to time t6 according to the control signal EM, the reset signal RST, and the scan signal Sn. With reference to Table 3 below, during the setting period P1, the control signal EM is a high potential voltage to turn off the circuit switching transistor 621_3, the switching transistor 622, and the respective pixel switching transistors of the pixel circuits 610_1 to 610_3.

During the reset period PR from time t1 to time t2, the reset signal RST switches from a high potential voltage to a low potential voltage to turn on the respective reset transistors of the pixel circuits 610_1 to 610_3 and respectively reset the storage capacitors of the pixel circuits 610_1 to 610_3. During the period PS from time t3 to time t4, the scan signal Sn switches from a high potential voltage to a low potential voltage to turn on the respective scan transistors of the pixel circuits 610_1 to 610_3 and respectively write the driving data into the storage capacitors of the pixel circuits 610_1 to 610_3. As shown in the operation states 2 to 3 of Table 1 below, the circuit node N61 maintains a low potential voltage, and the circuit node N62 maintains a high potential voltage to turn off the connection transistors 623_1 to 623_3.

During the driving period P2 between time t5 and time t6, the control signal EM is a low potential voltage to turn on the circuit switching transistor 621_3, the switching transistor 622, and the respective pixel switching transistors of the pixel circuits 610_1 to 610_3. The reset signal RST and the scan signal Sn are respectively high potential voltages to turn off the respective reset transistors and the scan transistors of the pixel circuits 610_1 to 610_3. As shown in the operation state 4 of Table 3 below, the circuit nodes N61 and N62 are high potential voltage, so as to turn off the connection transistors 623_1 to 623_3. It should be noted that since the scan transistor 621_21 and the reset transistor 621_22 of the switching circuit 621_2 may also receive the reset signal RST and the scan signal Sn, when signal (voltage) abnormality (a false trigger) of at least one of the reset signal RST and the scan signal Sn occurs, for example, when at least one of the reset signal RST and the scan signal Sn switches from a high potential voltage to a low potential voltage during the driving period P2, then at least one of the scan transistor 621_21 and the reset transistor 621_22 is conducted, and the circuit connection transistor 621_1 is thus conducted as well. As shown in the operation states 5 to 7 of Table 3 below, when signal (voltage) abnormality of at least one of the reset signal RST and the scan signal Sn occurs, the circuit nodes N61 and N62 may respectively switch to a low potential voltage to conduct the connection transistors 623_1 to 623_3. In this regard, the circuit connection transistor 621_1 may provide the reference voltage V1 to the control end of the connection transistors 623_1 to 623_3 through the switching transistor 622 and the circuit nodes N61, N62 to conduct the connection transistors 623_1 to 623_3. Next, the connection transistors 623_1 to 623_3 may respectively provide the protection voltage Vp to the respective driving transistors of the pixel circuits 610_1 to 610_3 to turn off the driving transistors. Therefore, the protection circuit 620 may effectively protect the diode elements in the pixel circuits 610_1 to 610_3 of the pixel 610 and may avoid the voltage signal abnormality of at least one of the reset signal RST and the scan signal Sn from causing the damage to the diode elements in the pixel circuits 610_1 to 610_3, which may thus achieve the current overload protection function of the pixel 610.

TABLE 3

| | control signal EM | reset signal RST | scan signal Sn | circuit node N61 | circuit node N62 |
|---|---|---|---|---|---|
| operation state 1 | high potential | low potential | low potential | low potential | high potential |
| operation state 2 | high potential | high potential | low potential | low potential | high potential |
| operation state 3 | high potential | low potential | high potential | low potential | high potential |
| operation state 4 | low potential | high potential | high potential | high potential | high potential |
| operation state 5 | low potential | low potential | high potential | low potential | low potential |
| operation state 6 | low potential | high potential | low potential | low potential | low potential |
| operation state 7 | low potential | low potential | low potential | low potential | low potential |

In addition, in some embodiments, the switching circuit 621_2 may include only one of the scan transistor 621_21 and the reset transistor 621_22, and when signal (voltage) abnormality of one of the scan signal Sn and the reset signal RST occurs, the protection circuit 620 may conduct the connection transistors 623_1 to 623_3 to turn off the respective driving transistors of the pixel circuits 610_1 to 610_3, which may thus achieve the current overload protection function of the pixel 610.

To sum up, the electronic device of the disclosure may self-detect one of the scan signal and the reset signal of the pixel through the protection circuit coupled to the pixel. When abnormality or a false trigger of one of the scan signal and the reset signal of the pixel occurs, the protection circuit may turn off the abnormal pixel, which may reduce the problem of diode element damage in the pixel caused by short circuit or high current.

Finally, it should be noted that: the above embodiments are only used to illustrate technical solutions of the disclosure and are not intended to limit the disclosure. Although the disclosure has been described in detail with reference to the above embodiments, people of ordinary skill in the art should understand that they may still modify the technical solutions described in the above embodiments, or replace some or all of the technical features therein with equivalents, and such modifications or replacements of corresponding technical solutions do not substantially deviate from the scope of the technical solutions of the embodiments of the disclosure.

What is claimed is:

1. An electronic device, comprising:

a pixel circuit, comprising a driving transistor; and a protection circuit, comprising:

a first connection transistor, coupled to the driving transistor;

a first switching transistor, coupled to the first connection transistor; and a logic circuit, coupled to the first switching transistor, wherein a first end of the first connection transistor is coupled to a protection voltage, a second end of the first connection transistor is coupled to the driving transistor, and a control end of the first connection transistor is coupled to a first end of the first switching transistor.

2. The electronic device according to claim 1, wherein the pixel circuit further comprises:

a pixel switching transistor, coupled to the driving transistor and receiving a control signal; and a diode element, coupled to the pixel switching transistor, wherein the first switching transistor receives the control signal.

3. The electronic device according to claim 1, wherein the pixel circuit further comprises:

a first scan transistor, coupled to the driving transistor and receiving a scan signal, wherein the logic circuit receives the scan signal.

4. The electronic device according to claim 1, wherein the pixel circuit further comprises:

a first reset transistor, coupled to the driving transistor and receiving a reset signal, wherein the logic circuit receives the reset signal.

5. The electronic device according to claim 1, wherein the logic circuit comprises:

a second connection transistor, coupled between the first switching transistor and a first reference voltage; and a switching circuit, coupled to the second connection transistor and receiving at least one of the scan signal and the reset signal.

6. The electronic device according to claim 5, wherein the logic circuit further comprises:

a second switching transistor, coupled to the first reference voltage, wherein the switching circuit is coupled between the second switching transistor and the second connection transistor.

7. The electronic device according to claim 6, wherein the switching circuit comprises at least one of a second scan transistor and a second reset transistor to receive at least one of the scan signal and the reset signal and to determine whether to provide the first reference voltage to the second connection transistor according to at least one of the scan signal and the reset signal.

8. The electronic device according to claim 6, wherein the logic circuit further comprises:

an impedance circuit, coupled to the switching circuit and the second connection transistor.

9. The electronic device according to claim 6, wherein the second switching transistor receives a control signal.

10. The electronic device according to claim 5, wherein the protection circuit further comprises:

an impedance circuit, coupled to a circuit node between the first switching transistor and the second connection transistor.

11. The electronic device according to claim 10, wherein the protection circuit further comprises:

a third switching transistor, coupled between the circuit node and the impedance circuit.

12. The electronic device according to claim 11, wherein the third switching transistor receives a control signal.

13. The electronic device according to claim 10, wherein the protection circuit further comprises:

a third switching transistor, coupled between the circuit node and the second connection transistor.

14. The electronic device according to claim 13, wherein the third switching transistor receives a control signal.

15. The electronic device according to claim 1, further comprising a plurality of pixel circuits, the protection circuit further comprising a plurality of first connection transistors, and the first connection transistors being respectively coupled to a plurality of driving transistors in the pixel circuits in a one-to-one manner.

16. The electronic device according to claim 15, wherein the plurality of pixel circuits are respectively pixel circuits corresponding to red sub-pixels, green sub-pixels, and blue sub-pixels.

17. The electronic device according to claim 1, wherein the first connection transistor and the first switching transistor are P-type transistors.

18. An electronic device, comprising:

a pixel circuit, comprising a driving transistor; and a protection circuit, comprising:

a first connection transistor, coupled to the driving transistor;

a first switching transistor, coupled to the first connection transistor; and a logic circuit, coupled to the first switching transistor, wherein the protection circuit further comprises:

an impedance circuit, coupled to a circuit node between the first connection transistor and the first switching transistor.

19. The electronic device according to claim 18, wherein an end of the impedance circuit is coupled to the circuit node between the first connection transistor and the first switching transistor, and another end of the impedance circuit is coupled to a first reference voltage.

* * * * *